US010003127B2

(12) United States Patent
Liu et al.

(10) Patent No.: US 10,003,127 B2
(45) Date of Patent: Jun. 19, 2018

(54) ANTENNA SYSTEM AND ISOLATOR STRUCTURE THEREOF

(71) Applicant: ACCTON TECHNOLOGY CORPORATION, Hsinchu (TW)

(72) Inventors: I-Ru Liu, Taipei (TW); Chang-Cheng Liu, Hsinchu County (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 8 days.

(21) Appl. No.: 15/242,593

(22) Filed: Aug. 21, 2016

(65) Prior Publication Data

US 2017/0271759 A1 Sep. 21, 2017

(30) Foreign Application Priority Data

Mar. 18, 2016 (TW) ..... 105108497 A

(51) Int. Cl.

| | |
|---|---|
| ***H01Q 1/52*** | (2006.01) |
| ***H01Q 21/28*** | (2006.01) |
| ***H01Q 21/24*** | (2006.01) |
| ***H01Q 9/42*** | (2006.01) |

(52) U.S. Cl.

CPC ..... *H01Q 1/521* (2013.01); *H01Q 9/42* (2013.01); *H01Q 21/24* (2013.01); *H01Q 21/28* (2013.01)

(58) Field of Classification Search

CPC ..... H01Q 1/22; H01Q 1/2258; H01Q 1/2266; H01Q 1/24; H01Q 1/241; H01Q 1/242; H01Q 1/243; H01Q 1/52; H01Q 1/521; H01Q 1/523; H01Q 1/525; H01Q 5/378; H01Q 5/385; H01Q 21/24; H01Q 21/28

See application file for complete search history.

(56) References Cited

U.S. PATENT DOCUMENTS

| | | | | |
|---|---|---|---|---|
| 9,287,919 | B2 * | 3/2016 | Harper | H04B 1/401 |
| 2015/0269400 | A1 * | 9/2015 | Poussot | G06K 7/10346 340/10.1 |
| 2016/0285161 | A1 * | 9/2016 | Apaydin | H01Q 1/525 |

* cited by examiner

*Primary Examiner* — Tho G Phan
*Assistant Examiner* — Patrick Holecek
(74) *Attorney, Agent, or Firm* — CKC & Partners Co., Ltd.

(57) ABSTRACT

An antenna system includes a skeleton, several first antenna components, several second antenna components, and several isolators. The first antenna components and the second antenna components are alternately arranged along edges of the skeleton and are spaced apart from each other. An operation band of the first antenna components is different from an operation band of the second antenna components. The isolators are arranged on the skeleton in a criss-cross and interlaced manner and surrounded by the first antenna components and the second antenna components. The isolators are configured to avoid signal interference between the first antenna components and the second antenna components.

8 Claims, 5 Drawing Sheets

ANTENNA SYSTEM AND ISOLATOR STRUCTURE THEREOF

RELATED APPLICATIONS

This application claims priority to Taiwan Application Serial Number 105108497, filed Mar. 18, 2016, which is herein incorporated by reference.

BACKGROUND

Field of Invention

The present invention relates to an antenna component. More particularly, the present invention relates to an antenna system and an isolator structure thereof.

Description of Related Art

With the rapid evolution of network connection technology, versatile network services have thus emerged to create demand for communication electronics that can be connected to the network by users. In response to this demand, various manufacturers consistently improve device performance and exterior design of their own communication electronics so as to enhance their product competitiveness. Generally speaking, manufacturers usually achieve the objectives of improving product performance and shrinking product volume through improving antenna systems. However, when considering the improvements of the antenna system, not only do the adjustment and control of its operating frequency need to be considered, but the labor cost consumed in manufacturing also needs to be evaluated.

For the forgoing reasons, there is a need to design an antenna system that can operate normally and has a shrunken module.

SUMMARY

An aspect of the present disclosure is directed to an antenna system. The antenna system comprises a skeleton, a plurality of first antenna components, a plurality of second antenna components, and a plurality of isolators. The plurality of first antenna components and the plurality of second antenna components are alternately arranged along edges of the skeleton and spaced apart from each other. An operation band of the first antenna components is different from an operation band of the second antenna components. The plurality of isolators are arranged on the skeleton in a criss-cross and interlaced manner and surrounded by the first antenna components and the second antenna components. The isolators are configured to avoid signal interferences between the first antenna components and the second antenna components.

Another aspect of the present disclosure is directed to an isolator applied to an antenna system. The antenna system comprises a plurality of first antenna components and a plurality of second antenna components. The first antenna components and the second antenna components are alternately arranged along edges of a skeleton and spaced apart from each other. An operation band of the first antenna components is different from an operation band of the second antenna components. The isolator structure comprises a plurality of isolators arranged on the skeleton in a criss-cross and interlaced manner and surrounded by the first antenna components and the second antenna components. The isolator structure is configured to avoid signal interferences between the first antenna components and the second antenna components.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
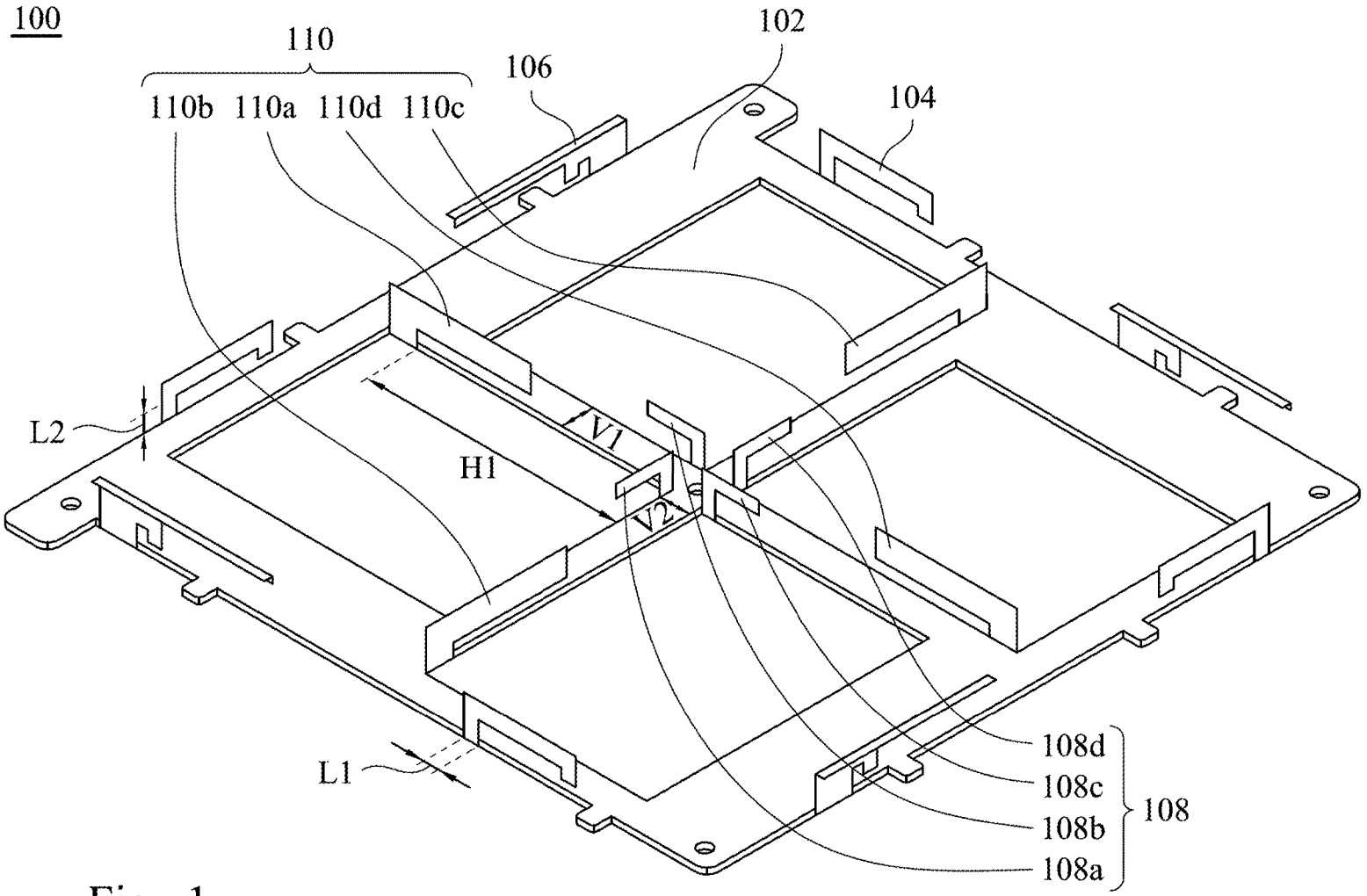
FIG. 1 depicts a three-dimensional schematic diagram of an antenna system according to some embodiments of this invention.

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. It is noted that, in accordance with the standard practice in the industry, the drawings are only used for understanding and are not drawn to scale. Hence, the drawings are not meant to limit the actual embodiments of the present disclosure. In fact, the dimensions of the various features may be arbitrarily increased or reduced for clarity of discussion. Wherever possible, the same reference numbers are used in the drawings and the description to refer to the same or like parts for better understanding.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

Furthermore, it should be understood that the terms, "comprising", "including", "having", "containing", "involving" and the like, used herein are open-ended, that is, including but not limited to. It will be understood that, as used herein, the phrase "and/or" includes any and all combinations of one or more of the associated listed items.

As used herein, the term "coupled" may also be termed "electrically coupled," and the term "connected" may be termed "electrically connected." "Coupled" and "connected" may also be used to indicate that two or more elements cooperate or interact with each other. It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments.

FIG. 1 depicts a three-dimensional schematic diagram of an antenna system according to some embodiments of this invention. As shown in FIG. 1, an antenna system 100 includes a skeleton 102, several first antenna components 104, several second antenna components 106, several first isolators 108, and several second isolators 110. The first antenna components 104, the second antenna components 106, the first isolators 108, and the second isolators 110 are all disposed on the skeleton 102. For example, a shape of the skeleton 102 may be a plane of a rectangular shape, but the present invention is not limited in this regard. In one embodiment, the shape of the skeleton 102 is the plane of the rectangular shape, and a length of one edge of the skeleton 102 is approximately from 80 millimeters (mm) to 130 millimeters.

In one embodiment, the first antenna components 104 and the second antenna components 106 are alternately arranged along edges of the skeleton 102 and are spaced apart from each other. For example, the first antenna components 104 and the second antenna components 106 are both disposed on the edges of the skeleton 102, all antenna components on the edges of the frame 102 adjacent to the first antenna components 104 are the second antenna components 106, all antenna components on the edges of the frame 102 adjacent to the second antenna components 106 are the first antenna components 104. In addition, the first antenna components 104 and the second antenna components 106 correspond to different operation bands. For example, the operation band to which the first antenna components 104 correspond may be one of 2.4 GHz wireless band supported by Wi-Fi and 5 GHz wireless band. The operation band to which the second antenna components 106 correspond may be the other one of 2.4 GHz wireless band supported by Wi-Fi and 5 GHz wireless band. However, the present invention is not limited in this regard.

Figure 2:
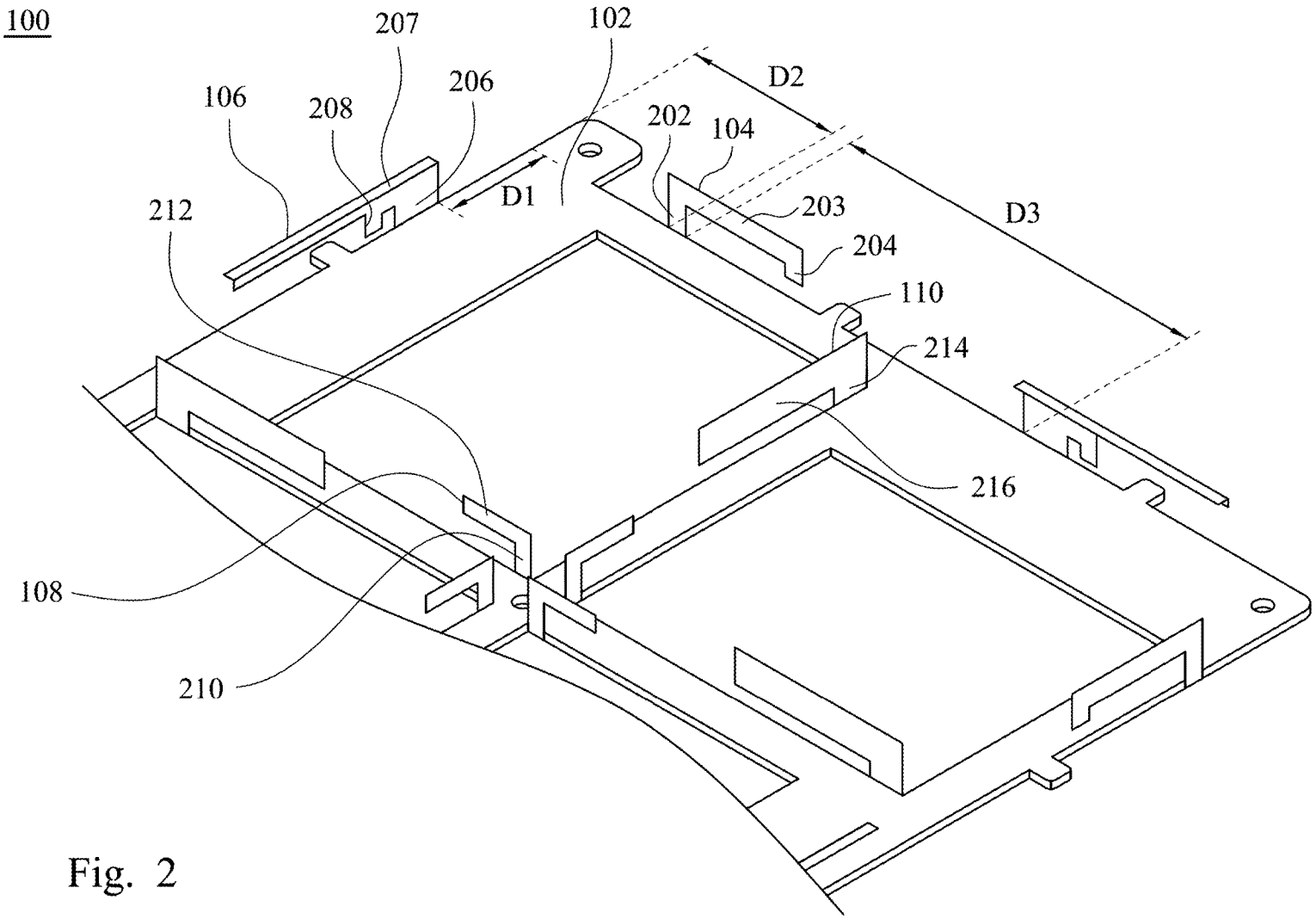
FIG. 2 depicts a three-dimensional schematic diagram of an antenna system according to some embodiments of this invention.

In one embodiment, the first antenna components 104 are implemented by inverted-F type antennas and are arranged along the edges of the skeleton 102, the second antenna components 106 are implemented by π type (Pi type) antennas and are arranged along the edges of the skeleton 102. However, the present invention is not limited to these types of antennas. For example, each of the first antenna components 104 includes a first ground portion (as shown in FIG. 2, a first ground portion 202), a first radiation portion (as shown in FIG. 2, a first radiation portion 203), and a first feeding portion (as shown in FIG. 2, a first feeding portion 204). Each of the second antenna components 106 includes a second ground portion (as shown in FIG. 2, a second ground portion 206), a second radiation portion (as shown in FIG. 2, a second radiation portion 207), and a second feeding portion (as shown in FIG. 2, a second feeding portion 208). The first ground portions 202 and the second ground portions 206 are grounded through the edges of the skeleton 102. The first radiation portions 203 are in a shape of inverted F to connect the first ground portions 202 and the first feed portions 204. The second radiation portions 207 are in a shape of π to connect the second ground portions 206 and the second feeding portions 208. The first feeding portions 204 and the second feeding portions 208 are configured to receive feed-in power supplies and respectively supply energies to the first antenna components 104 and the second antenna components 106. It should be understood that the above embodiment of the first antenna components 104 and the second antenna components 106 is only taken as an example and is not intended to limit the present invention.

In another embodiment, a horizontal length (as shown in FIG. 1, a horizontal length L1) of the first ground portions 202 is approximately from 7 millimeters to 11 millimeters. A vertical length (as shown in FIG. 1, a vertical length L2) of the first ground portions 202 is approximately from 3 millimeters to 5 millimeters. A horizontal length of the first radiation portions 203 is approximately from 25 millimeters to 41 millimeters. A vertical length of the first radiation portions 203 is approximately from 1 millimeter to 3 millimeters. A horizontal length of the first feeding portions 204 is approximately from 2 millimeters to 4 millimeters. A vertical length of the first feeding portions 204 is approximately from 4 millimeters to 6 millimeters. In addition, a horizontal length of the second ground portions 206 is approximately from 2 millimeters to 3 millimeters. A vertical length of the second ground portions 206 is approximately from 3 millimeters to 5 millimeters. A horizontal length of the second radiation portions 207 is approximately from 15 millimeters to 25 millimeters. A vertical length of the second radiation portions 207 is approximately from 3 millimeters to 5 millimeters. A horizontal length of the second feeding portions 208 is approximately from 1 millimeter to 3 millimeters. A vertical length of the second feeding portions 208 is approximately from 2 millimeters to 4 millimeters. Since the measurement methods of the horizontal lengths and vertical lengths of the above different components are similar to those of the horizontal length L1 and the vertical length L2 of the first ground portions 202 as shown, signs are not provided.

In still another embodiment, a vertical length of the first antenna components 104 is equal to a sum of the vertical length of the first ground portions 202 and the vertical length of the first radiation portions 203, a vertical length of the second antenna components 106 is equal to a sum of the vertical length of the second ground portions 206 and the vertical length of the second radiation portions 207.

In one embodiment, the first isolators 108 and the second isolators 110 are disposed on the skeleton 102 in a criss-cross and interlaced arrangement, and the first antenna components 104 and the second antenna components 106 are disposed along the edges of the skeleton 102 so that the first isolators 108 and the second isolators 110 are surrounded by the first antenna components 104 and the second antenna components 106 on the skeleton 102. For example, a criss-cross arrangement formed by the first isolators 108 and the second isolators 110 approximately divide an area surrounded by the first antenna components 104 and the second antenna components 106 disposed on the edges of the skeleton 102 into four isolation areas. Since the isolation areas divided by the first isolators 108 and the second isolators 110 have an effect of blocking signals correspondingly, possible signal interferences between the first antenna components 104/the second antenna components 106 located in different isolation areas can thus be reduced when they are operating. As a result, isolation during the operations of the first antenna components 104 and the second antenna components 106 can be improved to allow a relative distance between the first antenna components 104 and the second antenna components 106 thus disposed to be further decreased so as to achieve the objective of shrinking a module of the antenna system 100.

In another embodiment, the criss-cross arrangement formed by the first isolators 108 and the second isolators 110 are disposed from the edges of the skeleton 102. For example, the criss-cross arrangement formed by the first isolators 108 and the second isolators 110 may be regarded to have four end points extending outwards, which are respectively corresponding to four edges of the skeleton 102 rather than connected to corner points or vertices of the skeleton 102 where the edges intersect.

In one embodiment, the first isolators 108 and the second isolators 110 are implemented by L type isolators and are disposed on the skeleton 102, and the first isolators 108 are different from the second isolators 110. For example, each of the first isolators 108 includes a first support portion (as shown in FIG. 2, a first support portion 210) and a first blocking portion (as shown in FIG. 2, a first blocking portion 212). Each of the second isolators 110 includes a second support portion (as shown in FIG. 2, a second support portion 214) and a second blocking portion (as shown in FIG. 2, a second blocking portion 216). That is, either the first isolator 108 or the second isolator 110 is formed by combining the support portion and the blocking portion to present an L shape. In other words, both the first support portions 210 and the second support portions 214 are disposed to stand on the skeleton 102. The first blocking portions 212 and the second blocking portions 216 are respectively connected to the first support portions 210 and the second support portions 214 so that the first isolators 108 and the second isolators 110 are respectively in a shape of L. In addition, vertical lengths of the first isolators 108 and the second isolators 110 are the same as the vertical lengths of the first antenna components 104 and the second antenna components 106 disposed on the edges of the skeleton 102. Horizontal lengths of the first isolators 108 and the second isolators 110 respectively correlate with wavelengths corresponding to the operation bands of the first antenna components 104 and the second antenna components 106.

For example, in order to avoid that the first isolators 108 and the second isolators 110 to become equivalent antenna components so as to operate, horizontal lengths of the first blocking portions 212 of the first isolators 108 and the second blocking portions 216 of the second isolators 110 need to avoid matching specific percentages (such as a full wavelength, a half wavelength, a quarter wavelength, or a one-eighth wavelength . . . etc.) of the wavelengths respectively corresponding to the operation bands of the first antenna components 104 and the second antenna components 106. Therefore, in consideration of the previous description that the operation bands of the first antenna components 104 and the second antenna components 106 are different, it can be understood that the horizontal length of the first blocking portions 212 is different from the horizontal length of the second blocking portions 216. It should be understood that the above embodiment of the first isolators 108 and the second isolators 110 is only taken as an example and is not intended to limit the present invention.

In one embodiment, either one of the first isolators 108 and the second isolators 110 that have a shorter horizontal length between the horizontal lengths of the first blocking portions 212 and the second blocking portions 216 are arranged on the skeleton 102 in the criss-cross and interlaced manner, and an arrangement position is closely adjacent to a center of the skeleton 102. "Criss-cross" refers to the directivity relationships presented by the isolators when being disposed, and "interlaced" refers to spacing between the isolators when being disposed. In the present embodiment, since the horizontal length of the first blocking portions 212 of the first isolators 108 is shorter than the horizontal length of the second blocking portions 216 of the second isolators 110, the first isolators 108 are disposed in the central range of the skeleton 102 and are arranged in the central range of the skeleton 102 in the criss-cross and interlaced manner.

For example, the antenna system 100 includes four first isolators 108 (that is, first isolators 108*a*-108*d*). An extending direction of the first blocking portion 212 of the first isolator 108*a* is relatively perpendicular to extending directions of the first blocking portions 212 of the first isolators 108*b*/108*c*. The extending direction of the first blocking portion 212 of the first isolator 108*a* is relatively parallel to an extending direction of the first blocking portion 212 of the first isolator 108*d*, and the first blocking portions 212 of the first isolators 108*a*-108*d* respectively direct to the different edges (as shown in FIG. 1) of the skeleton 102 to present the criss-cross directivity relationships as mentioned above. In addition, the first support portion 210 of the first isolator 108*a* and the first support portions 210 of the first isolators 108*b*/108*c* are disposed on the skeleton 102 in an interlaced manner. In other words, vertical spacing V1/vertical spacing V2 are respectively between the first support portion 210 of the first isolator 108*a* and the first support portions 210 of the first isolators 108*b*/108*c*. In one embodiment, the vertical spacing V1 is approximately from 4 millimeters to 7 millimeters. The vertical spacing V2 is approximately from 4 millimeters to 7 millimeters. It should be understood that although in the above embodiment only the first isolator 108*a* is taken as an example for illustrating the configuration, the configuration method may be implemented by the first isolators 108*b*-108*d*.

In another embodiment, the horizontal length of the first blocking portions 212 is approximately from 10 millimeters to 16 millimeters. A vertical length of the first blocking portions 212 is approximately from 3 millimeters to 5 millimeters. A horizontal length of the first support portions 210 is approximately from 4 millimeters to 6 millimeters. A vertical length of the first support portions 210 is approximately from 3 millimeters to 4 millimeters. Since the measurement methods of the different horizontal lengths and vertical lengths are similar to those of the horizontal length L1 and the vertical length L2, signs are not provided.

In still another embodiment, the vertical length of the first isolator 108 is equal to a sum of the vertical length of the first blocking portions 212 and the vertical length of the first support portions 210, and the vertical length of the first isolators 108 is approximately equal to the vertical length of the first antenna components 104 or the vertical length of the second antenna components 106.

In addition, either one of the first isolator 108 and the second isolator 110 that has a longer horizontal length of the blocking portion is disposed between another isolator that has shorter blocking portion and the edges of the skeleton 102. In the present embodiment, since the horizontal length of the second blocking portions 216 of the second isolators 110 is longer than the horizontal length of the first blocking portions 212 of the first isolators 108, the second isolators 110 are disposed between the first isolators 108 and the edges of the skeleton 102, and the second isolators 110 relatively form a criss-cross arrangement with the first isolators 108 on the skeleton 102. In addition, the second blocking portions 216 of the second isolators 110*a*-110*d* respectively direct to the center of the skeleton 102, which is opposite to the directivities of the first blocking portions 212 of the first isolators 108*a*-108*d* (as shown in FIG. 1).

For example, the antenna system 100 includes four second isolators 110 (that is, second isolators 100*a*-110*d*). A directivity of the second blocking portion 216 of the second isolator 110*a* is relatively perpendicular to directivities of the second blocking portions 216 of the second isolators 110*b*/110*c*. The directivity of the second blocking portion 216 of the second isolator 110*a* is relatively parallel to a directivity of the second blocking portion 216 of the second isolator 110*d*, and the second blocking portions 216 of the second isolators 110*a*-110*d* all direct to the center of the skeleton 102 (as shown in FIG. 1). In the present embodiment, the second support portion 214 of the second isolator 110*a* is disposed relatively parallel to the first support portion 210 of the first isolator 108*b* and the second support portion 214 of the second isolator 110*a* is interlaced with the first support portion 210 of the first isolator 108*b* by the vertical spacing V1. The second support portion 214 of the second isolator 110*a* is disposed relatively perpendicular to the first support portion 210 of the first isolator 108*a* and the second support portion 214 of the second isolator 110*a* is interlaced with the first support portion 210 of the first isolator 108*a* by a horizontal spacing H1. Additionally, the second support portion 214 of the second isolator 110*a* is disposed parallel with the first support portion 210 of the first isolator 108*c* and the vertical spacing V1 between them is zero. In one embodiment, the vertical spacing V1 is approximately from 4 millimeters to 7 millimeters. The horizontal spacing H1 is approximately from 30 millimeters to 50 millimeters. It should be understood that although in the above embodiment only the second isolator 110*a* is taken as an example for illustrating the configuration, the configuration method may be implemented by the second isolators 110*b*-110*d*.

In another embodiment, the horizontal length of the second blocking portions 216 is approximately from 14 millimeters to 22 millimeters. A vertical length of the second blocking portions 216 is approximately from 5 millimeters to 7 millimeters. A horizontal length of the second support portions 214 is approximately from 4 millimeters to 6 millimeters. A vertical length of the second support portions 214 is approximately from 1 millimeter to 2 millimeters. In still another embodiment, the vertical length of the second isolators 110 is equal to a sum of the vertical length of the second blocking portions 216 and the vertical length of the second support portions 214, and the vertical length of the second isolators 110 is approximately equal to the vertical length of the first antenna components 104 or the vertical length of the second antenna components 106. Since the measurement methods of the different horizontal lengths and vertical lengths are similar to those of the horizontal length L1 and the vertical length L2, signs are not provided.

Through the above configuration method, the blocking (such as scattering), resulted from the first isolators 108 and the second isolators 110, of indirect emitting signals is reduced to allow the receiving and emitting of the signals by the antenna system to be more omnidirectional. It should be understood that the detailed configurations of the first isolators 108 and the second isolators 110 described above are only taken for example, and are not intended to limit the present invention.

In one embodiment, the vertical spacing V1 and the horizontal spacing H1 between the first isolator(s) 108 and the second isolator(s) 110 may be adjusted when designing the antenna system 100 depending on user demand. For example, through reserving the vertical spacing V1 and the horizontal spacing H1 between the first isolator(s) 108 and the second isolator(s) 110, the indirect emitting signals are not completely blocked by the first isolators 108 and the second isolators 110. For example, this kind of signals can bypass the first isolators 108 and the second isolators 110 through scattering so as to be received by the plurality of first antenna components in the antenna system 100. In other words, through the above configuration method, the antenna system 100 can support multi-input and multi-output (MIMO) technology. Since the detailed description of the vertical spacing V1 and the horizontal spacing H1 is the same as those of the previous embodiments, a description in this regard is not provided.

In one embodiment, the skeleton 102 is in a shape of a rectangle. Numbers of the first antenna components 104 and the second antenna components 106 are both four. Numbers of the first isolators 108 and the second isolators 110 are both four. Hence, the skeleton 102 includes the four edges, and each two adjacent edges are perpendicular to each other through the corner point. The first antenna component 104 and the second antenna component 106 stand along each of the four edges of the skeleton 102, and the first antenna components 104 and the second antenna components 106 are alternately disposed and spaced apart from each other along the edges of the skeleton 102. For example, all antenna components adjacent to the first antenna components 104 are the second antenna components 106, all antenna components adjacent to the second antenna components 106 are the first antenna components 104. On each of the two edges adjacent to a vertical corner point or vertex of the skeleton 102, the first antenna component 104 and the second antenna component 106 are disposed along a direction of each of the two edges of the skeleton 102 perpendicular to each other to form a configuration of vertical arrangement. In addition, the criss-cross arrangement formed by the first isolators 108 and the second isolators 110 may be regarded to have four end points extending outwards, which are respectively connected to centers of the edges of the skeleton 102 rather than connected to corner points between the edges of the skeleton 102. In the present embodiment, the second support portions 214 of the second isolators 110 are respectively disposed at positions between the first antenna components 104 and the second antenna components 106 on the edges of the skeleton 102.

FIG. 2 depicts a three-dimensional schematic diagram of an antenna system according to another embodiment of this invention. FIG. 2 shows part of the three-dimensional structure of the antenna structure 100 shown in FIG. 1, especially part of the isolation areas formed by dividing the skeleton 102 with the first isolators 108 and the second isolators 110 arranged in the criss-cross and interlaced manner. Since the detailed configuration methods of first antenna components 104, the second antenna components 106, the first isolators 108, and the second isolators 110 have been described in the previous embodiments, a description in this regard is not provided.

In one embodiment, the first antenna components 104 are implemented by inverted-F type antennas and are arranged along the edges of the skeleton 102, the second antenna components 106 are implemented by π type antennas and are arranged along the edges of the skeleton 102. However, the present invention is not limited to these types of antennas. For example, each of the first antenna components 104 includes the first ground portion 202, the first radiation portion 203, and the first feeding portion 204. Each of the second antenna components 106 includes the second ground portion 206, the second radiation portion 207, and a second feeding portion 208. The first ground portions 202 and the second ground portions 206 are grounded through the edges of the skeleton 102. The first radiation portions 203 are in the shape of inverted F to connect the first ground portions 202 and the first feed portions 204. The second radiation portions 207 are in the shape of π to connect the second ground portions 206 and the second feeding portions 208. The first feeding portions 204 and the second feeding portions 208 are configured to receive feed-in power supplies and respectively supply energies to the first antenna components 104 and the second antenna components 106. It should be understood that the above embodiment of the first antenna components 104 and the second antenna components 106 is only taken as an example and is not intended to limit the present invention.

In one embodiment, the first isolators 108 and the second isolators 110 are implemented by L type isolators and are disposed on the skeleton 102, and the first isolators 108 are different from the second isolators 110. For example, each of the first isolators 108 includes the first support portion 210 and the first blocking portion 212. Each of the second isolators 110 includes the second support portion 214 and the second blocking portion 216. Both the first support portions 210 and the second support portions 214 are disposed to stand on the skeleton 102. The first blocking portions 212 and the second blocking portions 216 are respectively connected to the first support portions 210 and the second support portions 214 so that the first isolators 108 and the second isolators 110 are respectively in the shape of L. In addition, the vertical lengths of the first isolators 108 and the second isolators 110 are the same as the vertical lengths of the first antenna components 104 and the second antenna components 106 disposed on the edges of the skeleton 102. The horizontal lengths of the first isolators 108 and the second isolators 110 respectively correlate with the wavelengths corresponding to the operation bands of the first antenna components 104 and the second antenna components 106.

For example, in order to avoid that the first isolators 108 and the second isolators 110 to become equivalent antenna components so as to operate, the horizontal lengths of the first blocking portions 212 of the first isolators 108 and the second blocking portions 216 of the second isolators 110 need to avoid matching specific percentages (such as a full wavelength, a half wavelength, a quarter wavelength, or a one-eighth wavelength . . . etc.) of the wavelengths respectively corresponding to the operation bands of the first antenna components 104 and the second antenna components 106. Therefore, in consideration of the previous description that the operation bands of the first antenna components 104 and the second antenna components 106 are different, it can be understood that the horizontal length of the first blocking portions 212 is different from the horizontal length of the second blocking portions 216. It should be understood that the above embodiment of the first isolators 108 and the second isolators 110 is only taken as an example and is not intended to limit the present invention.

In one embodiment, through adjusting relative distance between the first antenna components 104 and the second antenna components 106, antenna directivities and antenna polarization of the first antenna components 104 and the second antenna components 106, isolation between the first antenna components 104 and the second antenna components 106 of the antenna system 100 can be further enhanced during the operation to shrink the module volume of the antenna system 100.

For example, first, the first antenna components 104 and the second antenna components 106 are vertically disposed along the two edges of the skeleton 102 that are perpendicular to each other through the corner point according to the embodiment shown in FIG. 2. The directivities of the first antenna components 104 and the second antenna components 106 disposed along the two edges of the skeleton 102 that are perpendicular to each other depart from each other. In this manner, interferences between the first antenna components 104 and the second antenna components 106 when the signals are received or emitted are reduced.

Second, interferences between the first antenna components 104 having the same operation band are reduced when the signals are received or emitted through implementing a relative distance between the different first antenna components 104 and a relative vertical configuration of the different first antenna components 104. For example, the second antenna component 106 is disposed between the different first antenna components to increase the relative distance between the different first antenna components 104. In greater detail, since a distance D1, a distance D2, and a distance D3 exist between the ground portion 202 of the first antenna component 104 and the ground portions 206 of the two adjacent second antenna components 106, the relative distance between the different first antenna components 104 is thus increased. In addition, a substantive relative distance between the different first antenna components 104 can further be increased through the relative vertical configuration of the different first antenna components 104 so as to reduce interferences. In greater detail, through disposing two of the first antenna components 104 respectively on the two edges of the skeleton 102 perpendicular to each other, the two first antenna components 104 closer to each other present the relative vertical configuration. In one embodiment, the distance D1 is approximately from 7 millimeters to 12 millimeters. The distance D2 is approximately from 15 millimeters to 25 millimeters. The distance D3 is approximately from 32 millimeters to 53 millimeters. It should be understood that the above configuration method may also be implemented by the second antenna components 106.

Finally, isolation of the first antenna components 104/the second antenna components 106 in the different isolation areas during operations is enhanced through allowing polarization of the first antenna components 104 and the second antenna components 106 to be opposite to polarization of the first isolators 108 and the second isolators 110. For example, the first antenna components 104 and the second antenna components 106 may be vertically polarized, and the first isolators 108 and the second isolators 110 may be horizontally polarized. It should be understood that the polarization relationship described above between the antenna components and the isolators is only taken as an example and is not intended to limit the present invention.

The first antenna components 104, the second antenna components 106, the first isolators 108, and the second isolators 110 in the other isolation areas formed by dividing the skeleton 102 with the first isolators 108 and the second isolators 110 arranged in the criss-cross and interlaced manner may also use the above implementation and configuration method. Since the detailed implementation and configuration method is the same as that described above, a description in this regard is not provided.

Figure 3A:
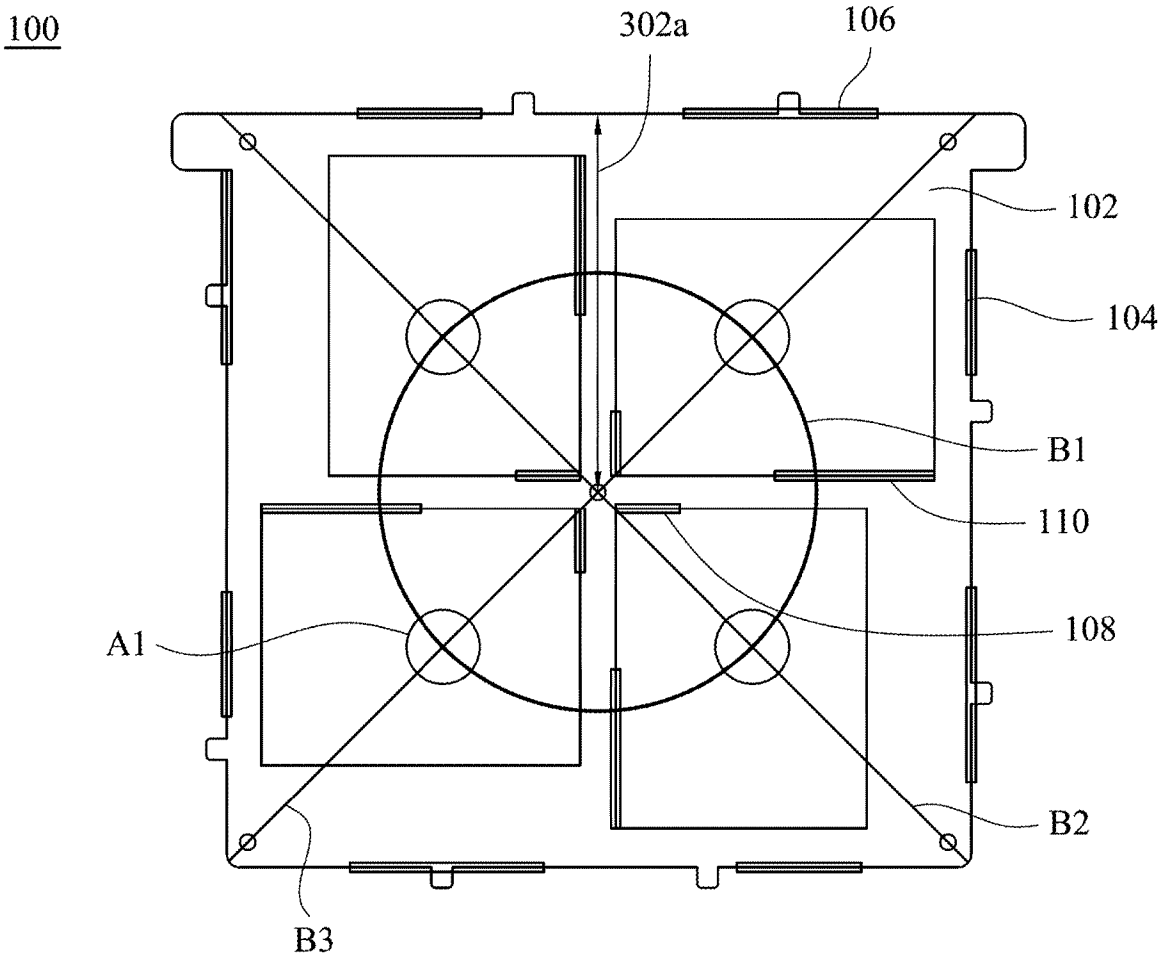
FIG. 3A to FIG. 3C depict plane schematic diagrams of antenna systems according to some embodiments of this invention.
Figure 3B:
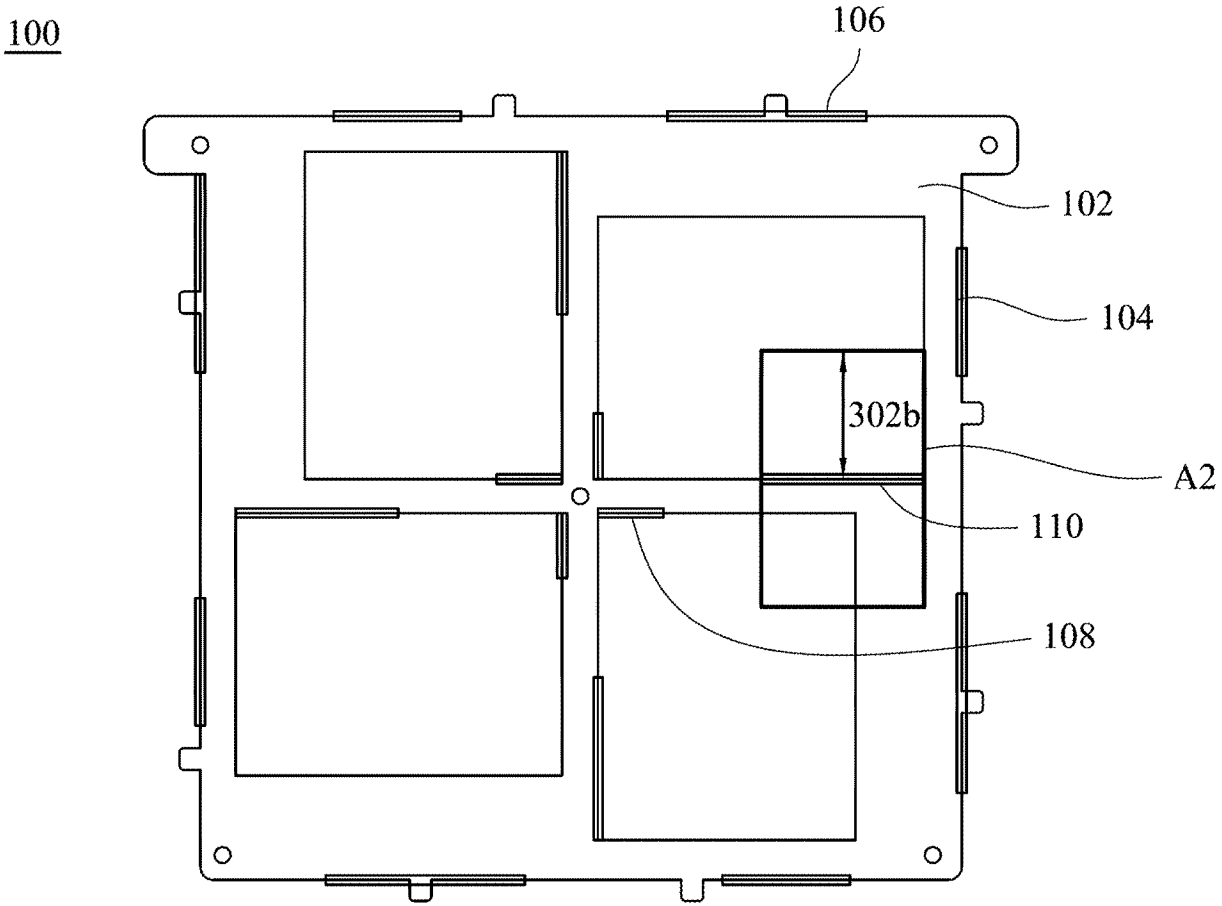
Figure 3C:
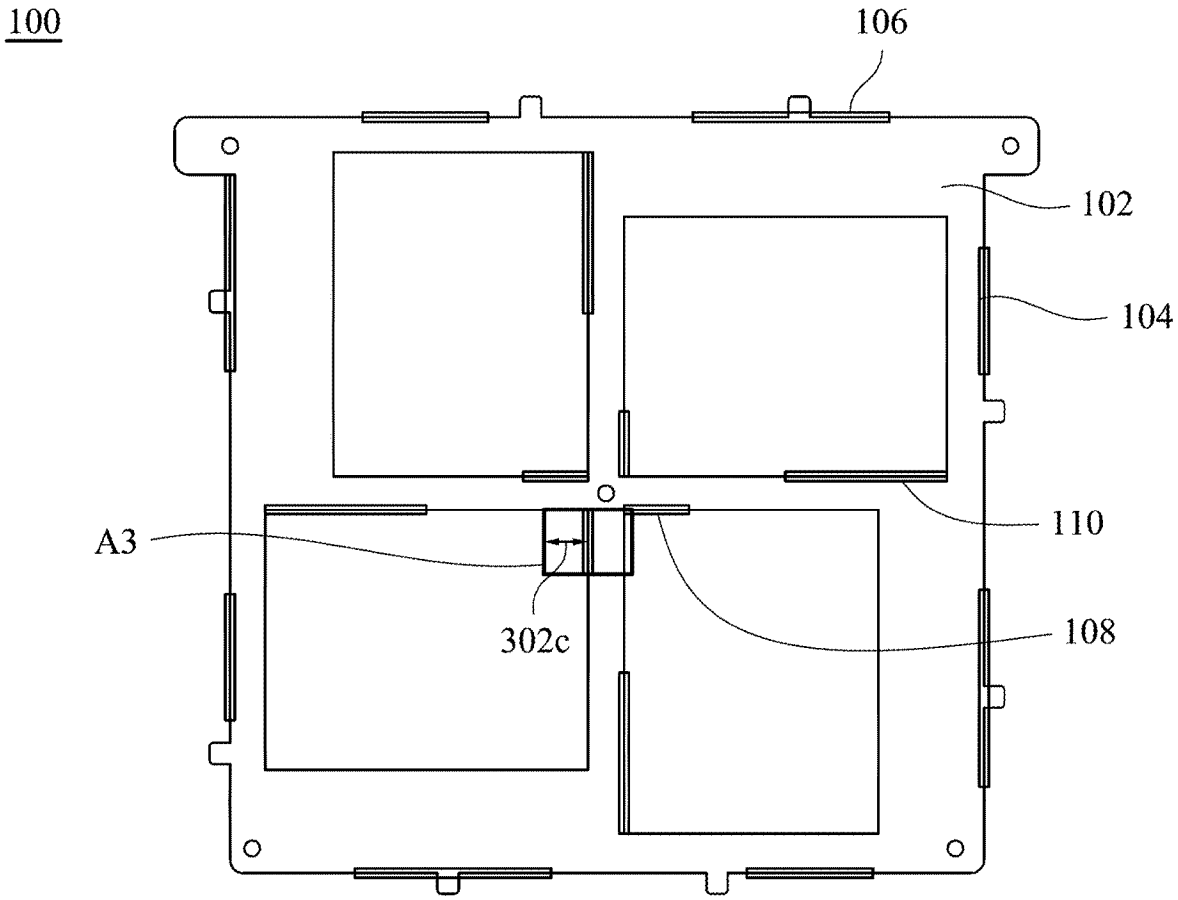

FIG. 3A, FIG. 3B, and FIG. 3C depict schematic diagrams of isolator structures disposed with antenna components according to embodiments of this invention. In one embodiment, a configuration method of the antenna components may be used by the antenna system 100, but the present invention is not limited to this. First, as shown in FIG. 3A, take the center of the skeleton 102 as a center of a circle, then use a vertical length 302*a* between the center of the skeleton 102 and the edges of the skeleton 102 as a diameter to draw a circle B1, and draw two straight lines B2 and B3 that cross to connect skeleton vertices and pass the center of the skeleton 102. After that, four prohibited areas A1 of the antenna components are generated according to four intersection points of the circle B1, the straight line B2, and the straight line B3. For example, in order to avoid that the first isolators 108 and the second isolators 110 become equivalent antenna components to operate because of inducing or some other passive effect, not any antenna component (such as the first antenna component 104 and the second antenna component 106) is allowed to be disposed in the four prohibited areas A1 of the antenna components. As a result, it is avoided that the first isolators 108 and the second isolators 110 become equivalent antenna due to excessive approach of the antennas. In addition, through implementing the four prohibited areas A1 of the antenna components, the phenomenon that the isolators serve as reflectors to reflect signals transmitted by the antenna components, which in turn increases interferences between signals and over directivities, is also avoided. It should be understood that the above detailed configuration of the prohibited areas A1 of the antenna components is only taken as an example and is not intended to limit the present invention. For example, the vertical length 302*a* is not limited to a vertical distance between the center of the skeleton 102 and the edges of the skeleton 102.

Second, as shown in FIG. 3B, take any point of any of the second isolators 110 as a basis, then use a quarter wavelength corresponding to the operation band of the antenna system 100 as a length 302*b* to vertically extend the length 302*b* towards the edges of the skeleton 102 that are disposed parallel with the second isolator 110. A prohibited area A2 of the antenna components is thus generated. For example, in order to avoid that the first isolators 108 and the second isolators 110 become equivalent antenna components to operate, not any antenna component (such as the first antenna component 104 and the second antenna component 106) is allowed to be disposed in the prohibited area A2 of the antenna components. In addition, through implementing the prohibited area A2 of the antenna components, the phenomenon that the isolators serve as reflectors to reflect signals transmitted by the antenna components, which in turn increases interferences between signals and over directivities, is also avoided. It should be understood that the above detailed configuration of the prohibited area A2 of the antenna components is only taken as an example and is not intended to limit the present invention. For example, the length 302*b* is not limited to the quarter wavelength corresponding to the operation band of the antenna system 100.

Finally, as shown in FIG. 3C, take any point of any of the first isolators 108 as a basis, then use a quarter wavelength corresponding to the operation band of the antenna system 100 as a length 302*c* to vertically extend the length 302*c* towards the edges of the skeleton 102 that are disposed parallel with the first isolator 108. A prohibited area A3 of the antenna components is thus generated. For example, in order to avoid that the first isolators 108 and the second isolators 110 become equivalent antenna components to operate, not any antenna component (such as the first antenna component 104 and the second antenna component 106) is allowed to be disposed in the prohibited area A3 of the antenna components. In addition, through implementing the prohibited area A3 of the antenna components, the phenomenon that the isolators serve as reflectors to reflect signals transmitted by the antenna components, which in turn increases interferences between signals and over directivities, is also avoided. It should be understood that the above detailed configuration of the prohibited area A3 of the antenna components is only taken as an example and is not intended to limit the present invention. For example, the length 302*c* is not limited to the quarter wavelength corresponding to the operation band of the antenna system 100.

According to the above embodiments, the present invention disposes and integrates the antenna components and the isolators on the skeleton by specific arrangement methods to achieve high isolation during the operations of the antenna components. Through the present invention technology, the isolation during the operations of the antenna components can be enhanced to decrease the relative distance between the different antenna components so as to achieve the objective of shrinking the overall antenna system volume, by using the configuration method of the antenna components, the configuration method of the isolators, and the configuration relationship between the antenna components and the isolators. Through adjusting directivities and polarization of the different antenna components and the distance between the different antenna components, the isolation between the antenna components can be further enhanced. In addition, through the configuration method of the isolators according to the present invention, the blocking (such as scattering) of signals that are not directly emitted by the isolators is reduced to allow the receiving and emitting of the signals by the antenna system to be more omnidirectional and the multi-input and multi-output (MIMO) technology can be supported.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna system comprising:

a skeleton;

a plurality of first antenna components and a plurality of second antenna components, alternately arranged along edges of the skeleton and spaced apart from each other, wherein an operation band of the first antenna components being different from an operation band of the second antenna components;

a plurality of first isolators, arranged in the criss-cross and interlaced manner and disposed close to a center of the skeleton; and a plurality of second isolators, respectively disposed between the first isolators and the edges of the skeleton correspondingly;

wherein the first isolators and the second isolators are surrounded by the first antenna components and the second antenna components, and configured to avoid signal interferences between the first antenna components and the second antenna components;

wherein the first isolators and the second isolators having opposite directivities to the first isolators are disposed on the skeleton in an relatively interlaced manner.

2. The antenna system of claim 1, wherein each of the first isolators comprises:

a first support portion, disposed on the skeleton; and a first blocking portion, connected to the first support portion, the first support portion and the first blocking portion being connected perpendicular to each other to present a L shape;

each of the second isolators comprises:

a second support portion, disposed on the skeleton; and a second blocking portion, connected to the second support portion, the second support portion and the second blocking portion being connected perpendicular to each other to present the L shape, wherein a horizontal length of the first blocking portion is shorter than a horizontal length of the second blocking portion.

3. The antenna system of claim 2, wherein vertical lengths of the first isolators and the second isolators are equal to a vertical length of the first antenna components or a vertical length of the second antenna components, the horizontal lengths of the first isolators and the second isolators do not match percentage lengths, wherein the percentage lengths correspond to wavelengths respectively corresponding to operation bands of the first antenna components and the second antenna components.

4. The antenna system of claim 1, wherein a polarization direction of the first antenna components and the second antenna components is different from a polarization direction of the plurality of isolators.

5. An isolator structure applied to an antenna system, the antenna system comprising a plurality of first antenna components and a plurality of second antenna components alternately arranged along edges of a skeleton and spaced apart from each other, wherein an operation band of the first antenna components being different from an operation band of the second antenna components, the isolator structure comprising:

a plurality of first isolators, arranged in the criss-cross and interlaced manner and disposed close to a center of the skeleton; and a plurality of second isolators, respectively disposed between the first isolators and the edges of the skeleton correspondingly;

wherein the first isolators and the second isolators are surrounded by the first antenna components and the second antenna components, and configured to avoid signal interferences between the first antenna components and the second antenna components;

wherein the first isolators and the second isolators having opposite directivities to the first isolators are disposed on the skeleton in an relatively interlaced manner.

6. The isolator structure of claim 5, wherein each of the first isolators comprises a first support portion and a first blocking portion perpendicular to each other to present a L arrangement, the first support portion is disposed on the skeleton, the first blocking portion is connected to the first support portion; each of the second isolators comprises a second support portion and a second blocking portion perpendicular to each other to present the L arrangement, the second support portion is disposed on the skeleton, the second blocking portion is connected to the second support portion, wherein a horizontal length of the first blocking portion is shorter than a horizontal length of the second blocking portion.

7. The isolator structure of claim 6, wherein vertical lengths of the first isolators and the second isolators are equal to a vertical length of the first antenna components or a vertical length of the second antenna components, and the horizontal lengths of the first isolators and the second isolators do not match percentage lengths, wherein the percentage lengths correspond to wavelengths respectively corresponding to operation bands of the first antenna components and the second antenna components.

8. The isolator structure of claim 6, wherein a polarization direction of the first antenna components and the second antenna components is different from a polarization direction of the plurality of isolators.

* * * * *